US005782664A

United States Patent [19]

Casters

[11] Patent Number: 5,782,664

[45] Date of Patent: Jul. 21, 1998

[54] MOTORIZED CRAFT FOR PROPELLING A PERSON LYING IN A HORIZONTAL POSITION

[76] Inventor: Laurent Casters, 46, rue du Vallon, Epinal, France, 88000

[21] Appl. No.: 869,379

[22] Filed: Jun. 5, 1997

Related U.S. Application Data

[63] Continuation of Ser. No. 596,255, filed as PCT/FR95/00703, May 31, 1995, abandoned.

[30] Foreign Application Priority Data

Jun. 7, 1994 [FR] France ..... 94 07104

[51] Int. Cl.[6] ..... B63B 1/00

[52] U.S. Cl. ..... 441/65; 114/315; 114/242

[58] Field of Search ..... 114/270, 315, 114/242; 440/6, 38, 113; 441/65

[56] References Cited

U.S. PATENT DOCUMENTS

| | | | |
|---|---|---|---|
| 1,579,529 | 4/1926 | Haschke | 441/65 |
| 2,708,759 | 5/1955 | Strawn | 441/65 |
| 3,543,712 | 12/1970 | Vasilatos | 441/55 |
| 5,083,948 | 1/1992 | Grobson | 440/49 |
| 5,158,034 | 10/1992 | Hsu | 114/315 |
| 5,362,269 | 11/1994 | Leach | 441/65 |
| 5,388,543 | 2/1995 | Ditchfield | 114/315 |
| 5,399,111 | 3/1995 | Kobayashi et al. | 441/65 |

FOREIGN PATENT DOCUMENTS

WO9405375 3/1994 WIPO .

*Primary Examiner*—Ed L. Swinehart
*Attorney, Agent, or Firm*—Weiser and Associates P.C.

[57] ABSTRACT

Motorized craft, for propelling a person lying in a horizontal position, comprising a hull (1), a water pipe extending through the craft longitudinally on which a propeller is located and two handles (4) designed to be grasped by the user. The craft of the invention is characterized in that said hull (1) includes on the rear part thereof a surface (2) for supporting the user lying on his stomach, so that at least one portion of his body is supported. The user guides the craft by simply applying pressure with his forearm on the side to which he wants to turn, his legs acting as the rudder. The craft of the invention is simple, light and compact and fits easily into the boot of the car, making it rapid and handy to use.

10 Claims, 1 Drawing Sheet

MOTORIZED CRAFT FOR PROPELLING A PERSON LYING IN A HORIZONTAL POSITION

This is a continuation of Ser. No. 08/596.255 filed on Feb. 7. 1996 filed as PCT/FR95/00703. May 31. 1995 (now abandoned).

BACKGROUND OF THE INVENTION

The present invention concerns a small motorized boat for transporting a person in a ventral lying-down position on the surface of the water.

There are already existing various devices of this type, for example those described in the documents FR-1.564.945. U.S. Pat. No. 3.789.792. GB-1.545.222 and WO-9200124.

Such devices generally comprise a fairing making it possible to protect the motor device. a water pipe traversing the machine from front to rear and in which there is a propelling screw. and handles placed at the rear of the machine. During operation. the user of the machine holds each handle in one hand and lets himself be pulled by said machine. The body of the user is thus dragged onto the water surface without being protected against any obstacles or impacts. and the handling of the machine. in particular for changes of direction. is relatively difficult.

SUMMARY OF THE INVENTION

The object of the present invention is to mitigate the drawbacks of the prior art by providing a hull which comprises on its rear portion a support surface on which the user rests in a ventral lying-down position so as to have at least one part of his body supported.

Preferably, the support surface slants over at least one part of its length so as to raise the upper part of the user. and includes two lateral edges. In addition, the support surface comprises two rear floats on which the user could rest his bent elbows whilst he holds onto the two handles of the boat.

BRIEF DESCRIPTION OF THE DRAWINGS

The invention shall be more readily understood from a reading of the following description with reference to the accompanying figures.

DETAILED DESCRIPTION OF PREFERRED EMBODIMENTS

Figure 1:
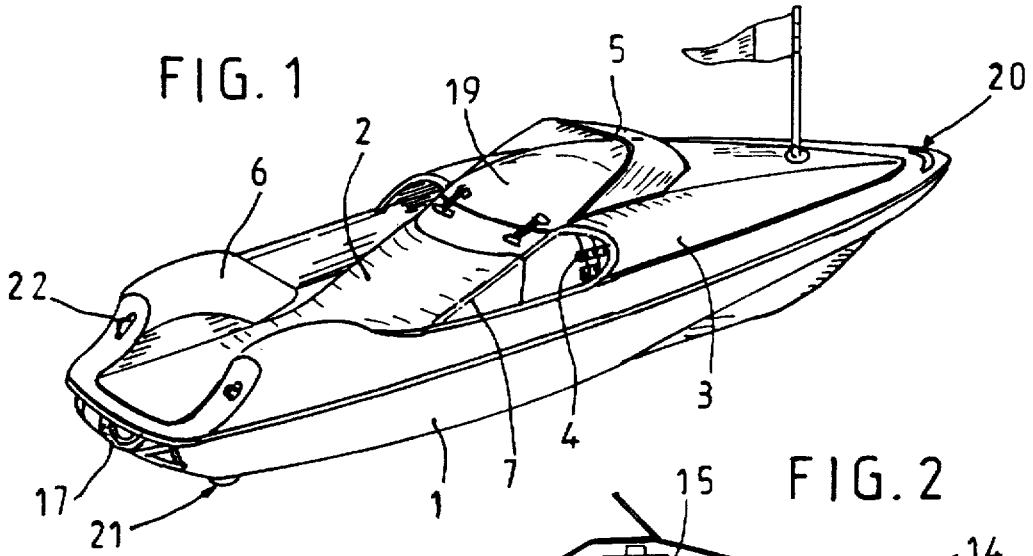
FIG. 1 is an isometric view of the boat.
Figure 2:
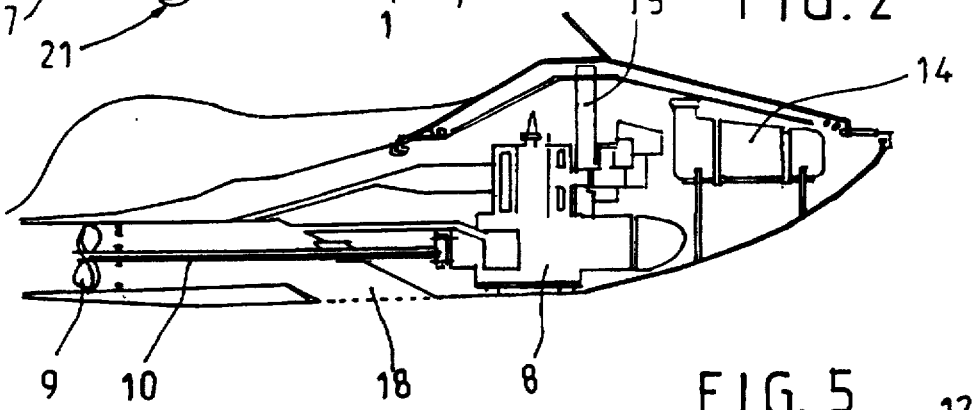
FIG. 2 is a longitudinal cross-sectional view of the boat of FIG. 1.

The boat of FIGS. 1 and 2 is formed of a hull (1). for example made of moulded plastic, contains a mechanical unit for motorizing the boat and protects said unit against water and impacts.

The lower portion of the hull has a suitably-adapted shape to facilitate gliding on water.

Figure 3:
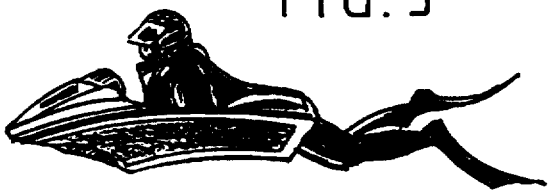
FIG. 3 is an illustration of a diver using the boat of FIG. 1.

The hull (1) has in addition on its rear portion a support surface (2) on which the user takes support in a ventral lying-down position so as to have his chest or chest and pelvis supported as shown in FIG. 3. The support surface. (2) is preferably slanted over at least one portion of its length so as to raise the chest of the user. and preferably has lateral edges (7).

The user holds onto the boat with the aid of two lateral handles (4) fitted in the hull and can rest his bent elbows (folded) on the two rear floats (6). Moreover. this makes it possible to non-restrictively protect the hands and arms of the user by two wing tips (3) and to protect his body and face by a windscreen (5) having any suitably-adapted aerodynamic shape.

The pressure of the forearms on the hull. the gripping of the user by means of the handles and his legs remaining inside the boat enable him to bend and control the latter.

The hull also carries out several functions including boot-topping. gliding. providing support and protection of the user. and guiding of the boat.

The propulsion mechanical unit includes at least one motor. such as a petrol motor (18) mechanically linked to a propelling screw (9) inside a water pipe (10).

According to the embodiment of FIGS. 1 and 2. the pipe (10) comprises a water intake (18) under the hull and a rear central outlet (17).

Figure 5:
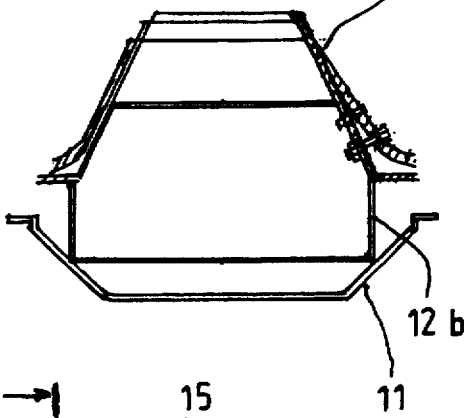
FIG. 5 is a transverse sectional view of the alternative embodiment boat of FIG. 4.
Figure 4:
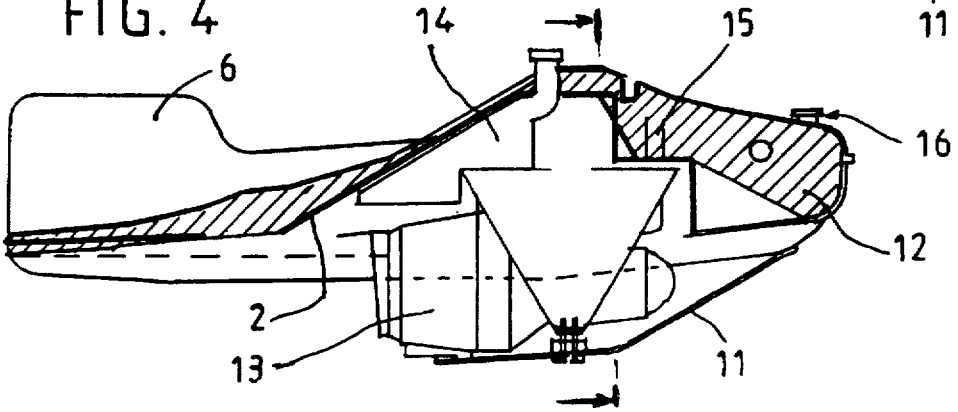
FIG. 4 is a longitudinal cross-sectional view of an alternative embodiment boat.

According to an alternative embodiment shown in FIGS. 4 and 5. the hull is formed of a caisson comprising two portions (12*a*) and (12*b*) and a protection shoe (11) ensuring gliding and protection against impacts and obstacles. The boat is propelled by a fully immersed turbine (13) and also comprises a user support surface (2).

According to a further variant. shown in phantom in FIG. 2. it is possible to also protect the legs of the user by an extension (22) of the support surface (2). such as a monoblock or movable extension.

According to a further variant (not shown). a directional device may be added. for example a tube (such as the tube (17) of FIG. 1) able to be oriented at the outlet of the pipe.

Other non-restrictive elements, such as a fuel tank (14). air intake (15). drain stopper (16). rear floater (6). storage boxes and trap door to the motor (19) are not described in detail. their shape and location being selected according to the desired embodiment for the boat.

The low cost of the boat of the present invention is one of its main advantages. the others being described hereafter.

The development of new aquatic sports should be adapted to all geographical sites. including river reaches. lakes. rivers. streams. sea. etc.

With the boat of the present invention. a new generation of leisure sport is open to a full range of customers of all ages and physical condition. such as sportsmen/sportswomen. non-sportsminded persons. safety bodies. etc.

The boat of the present invention is a small boat whose guiding is effected via a simple pressure of the forearms on the side to which it is desired to turn. the legs acting as a rudder. This simplified. light-weight boat. with a small spatial requirement. can be held in a car boot and permits rapid practical use. For example. divers. divers without breathing equipment. hunters and scuba divers can arrive at diving sites without being overtired. An essential safety device on the surface marks out divers with an "ALPHA" signal. which limits the approach of any ship within at least 100 meters. The possibility of leaving a block swinging at 3 meters avoids any decompression accident occurring.

The boat of the invention easily carries two persons in addition to the pilot (by ropes attached to the rear rings (17)). which makes it a remarkable assistance and safety appendage for small and medium-sized ships, but also for swimming lifesavers where seconds are vital.

This small boat is also a pleasure device for wavesurfing, can pull the surfers up to the best wave and go down rivers and streams and is suitable for water skiers on river reaches. Competitions can be organised extremely quickly.

The motorized system is adapted to the use of a 2-stroke motor from 48 $cm^3$ to 400 $cm^3$, indeed more, or even with an electric motor.

It is possible to provide various accessories including a handle (20) at the front of the hull and one or several wheels (21) under the hull so as to facilitate handling and transport out of water.

I claim:

1. A motorized boat for moving a user in a lying-down position on a water surface, comprising a hull for protecting a propulsion unit, two handles for gripping by the user, and two rear floats upon which the user rests folded elbows while the user grips the two handles of the boat, wherein the hull includes a support surface along a rear portion of the hull for supporting the user in a ventral lying-down position so as to support at least one portion of the user's body, and wherein the handles and the rear floats are positioned for maintaining the hands and arms of the user within interior portions of the boat, such that the user controls the boat by applying sideward forearm pressure on the hull and by gripping the handles, with the user's legs remaining at least partially inside the boat.

2. The boat of claim 1 wherein at least a portion of the support surface is slanted over its length, for lifting upper portions of the user.

3. The boat of claim 1 wherein the support surface includes two lateral edges.

4. The boat of claim 1 wherein the support surface includes an extension portion.

5. The boat of claim 1 which further comprises at least one rear ring for carrying other persons.

6. The boat of claim 1 which further comprises a handle located along front portions of the hull, and at least one wheel under the hull.

7. The boat of claim 1 which further comprises two wings tips, for protecting the hands and arms of the user.

8. The boat of claim 1 which further comprises a windscreen for protecting the body of the user.

9. The boat of claim 1 wherein the hull is formed of a box comprised of two complementary portions and a protection shoe.

10. The boat of claim 1 wherein the propulsion unit includes at lease one motor, and a water pipe longitudinally traversing the boat and containing a propulsion helix.

* * * * *